US006191745B1

(12) United States Patent
Heed

(10) Patent No.: US 6,191,745 B1
(45) Date of Patent: Feb. 20, 2001

(54) ANTENNA

(76) Inventor: Björn Heed, Utlandagatan 19, SE-412 61 Göteborg (SE)

( * ) Notice: Under 35 U.S.C. 154(b), the term of this patent shall be extended for 0 days.

(21) Appl. No.: 09/117,211

(22) PCT Filed: Jan. 28, 1997

(86) PCT No.: PCT/SE97/00126

§ 371 Date: Jul. 22, 1998

§ 102(e) Date: Jul. 22, 1998

(87) PCT Pub. No.: WO97/28575

PCT Pub. Date: Aug. 7, 1997

(30) Foreign Application Priority Data

Jan. 30, 1996 (SE) ..... 9600321

(51) Int. Cl.[7] ..... H01Q 1/32
(52) U.S. Cl. ..... 343/713; 343/715
(58) Field of Search ..... 343/713, 715, 343/711, 720, 712, 834, 818

(56) References Cited

U.S. PATENT DOCUMENTS

| | | | | |
|---|---|---|---|---|
| 3,634,864 | * | 1/1972 | Trachtenberg | 343/713 |
| 5,083,135 | * | 1/1992 | Nagy et al. | 343/713 |
| 5,099,252 | | 3/1992 | Bryant et al. | 343/713 |
| 5,155,494 | * | 10/1992 | Bryant et al. | 343/713 |
| 5,596,316 | * | 1/1997 | Honeck | 340/825.03 |
| 5,633,645 | * | 5/1997 | Day | 343/700 MS |

FOREIGN PATENT DOCUMENTS 0137391 9/1984 (EP) .

* cited by examiner

*Primary Examiner*—Don Wong
*Assistant Examiner*—James Clinger
(74) *Attorney, Agent, or Firm*—Orum & Roth

(57) ABSTRACT

Antenna element fastened to an automobile window which without being connected to a mobile telephone by means of a cable enhances the possibilities of transmitting and receiving inside an automoble.

12 Claims, 1 Drawing Sheet

ANTENNA

To obtain good function of a radio transmitter or receiver it is necessary that the antenna function is good, i.e. that the apparatus has a good ability to receive signals and likewise a good ability to send out signals. There are many different designs of antennas, all of them having their own characteristics regarding efficiency, direction of effect, size, complexity, cost etc.

Especially for hand-held, so called mobile telephones, the size and handling aspects are essential. When a mobile telephone is used inside an automobile, the car body steel plate acts as a shield and reflector for the radio waves, with the result that the transmitting and receiving conditions inside an automobile often are poor. Mobile telephones in cars are therefore often used with an outer antenna which is placed on the outside of the car body steel plate. This results in better transmitting and receiving conditions.

This however is achieved at the cost of increased complexity and reduced comfort. One has to mount such an outside antenna, thereby often causing damage. When one wants to use one's mobile telephone one then has to connect it by means of a cable.

That an antenna has to be connected to its radio to be able to function may seem inevitable. However, many antennas are composed of many parts, all of which are not directly connected to the radio by means of a cable or other conductor. A common type of antenna used with television receivers is the so called YAGI-antenna where only one of many elements of the antenna is connected by means of a cable. The other elements thus are not directly connected by means of conductors but are nontheless important for the function of the antenna. They are made from electrically conductive material and made in such a way that they can reflect radio waves, and also through resonance phenomena oscillate with the radio waves and thus enhance the effect of the connected element.

The present invention concerns a way of utilising such non connected antenna elements in conjunction with the ordinary antenna of a mobile telephone to form an antenna system that enhances the transmitting and receiving properties inside an automobile.

Figure 1:
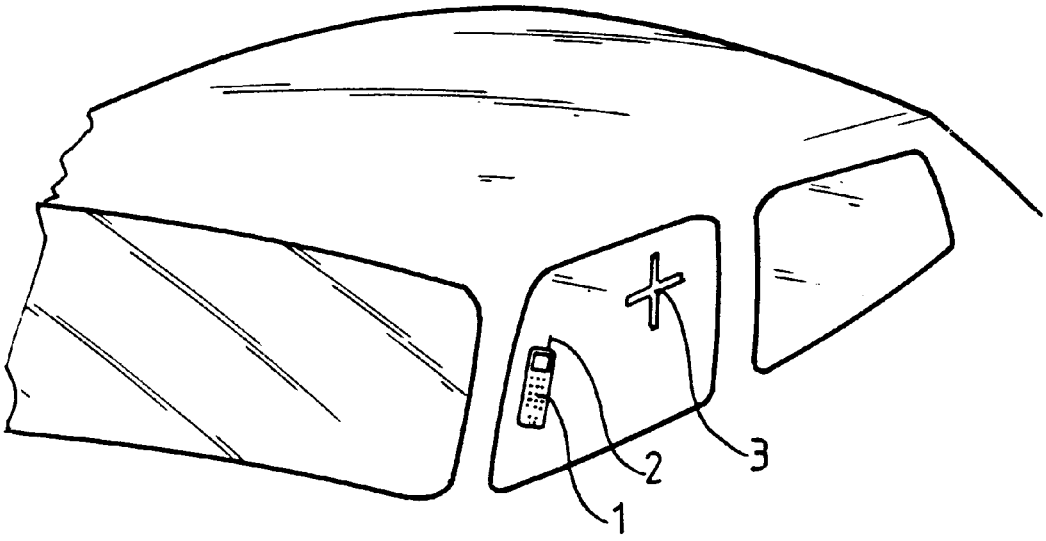

One example of the invention is shown in FIG. 1, where 1 is a hand held mobile telephone which is used inside an automobile. Reference 2 designates the ordinary mobile-telephone antenna. This cooperates with an extra antenna element 3 fastened to the side window of the automobile. This combined antenna system shows an enhanced effect when compared with the ordinary antenna alone.

Figure 2:
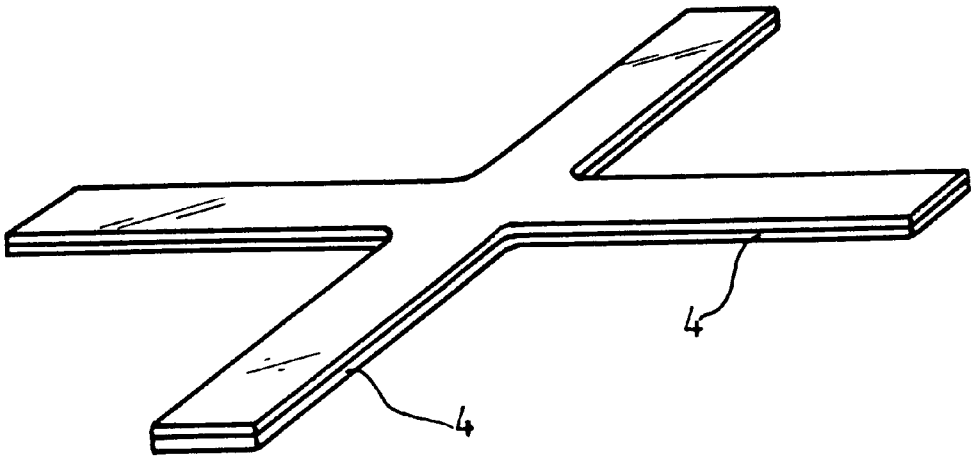

The extra antenna element 3 is shown in closer detail in FIG. 2. It consists of a thin foil of aluminium or other electrically conductive material which is provided with an adhesive layer 4 so that it can easily be fastened to the automobile window. To function well regardless of the direction of the primary antenna, the element is made in the form of a cross with arms of like length so adapted as to show resonance at the radio frequency used.

The invention however is not limited to this example. The extra antenna element can be fastened in other ways, for example by means of glue or some mechanical device. Nor is the cross shape critical. An L-form may in certain cases be preferable. Even one single straight wire or tape of the right length, i.e. so that it is in resonance with the radio waves, applied in the right direction can function well. An automobile or automobile window can also be equipped with several different antenna elements.

Automobile windows are intended to give driver and passengers a good view-out of the car. Even a rather thin tape of opaque material can then be disturbing. In another example of the invention transparent antenna elements are used. The automobile window may for example be provided with an applied pattern of transparent but electrically conductive material instead of the earlier mentioned aluminium foil. The use of transparent but electrically conductive layers of metal oxides for the heating of glass panes for the purpose of preventing the formation view-disturbing condensation on the doors of freezing cabinets and such things constitutes known technology.

What is claimed is:

1. A passive antenna element to be applied to an automobile window to one of an inside and outside thereof, said passive antenna element for improving radiation signals transmitted and received by a mobile telephone having a primary antenna, wherein said passive antenna comprises a thin layer of electrically conductive material for application to one of said window sides, said passive antenna having two legs disposed at right angles to each other, wherein said passive antenna is cordlessly connected to said primary antenna.

2. The antenna element according to claim 1, wherein said conductive material is transparent.

3. The antenna element according to claim 1, wherein said conductive material is provided with an adhesive layer for fastening to the window.

4. The antenna element according to claim 1, wherein each of said legs are collectively configured as a cross.

5. The antenna element according to claim 1, wherein each of said legs are collectively configured as an L.

6. A passive antenna system for attachment to one of an outside and inside surface of a window panel, comprising:

A mobile telephone for transmitting and receiving polarized radio wave signals, said mobile telephone including a primary antenna;

a second antenna adapted for wireless connection to said primary antenna, said second antenna attached to said window pane and made of an electronically conductive transparent material having two legs disposed at right angles to each other for improving a vertical and horizontal polarized radiation signal transmitted or received from said mobile telephone, wherein said legs receive and re-transmit resonant signal independent of a position of the mobile phone.

7. The antenna system according to claim 6 wherein said second antenna is provided with an adhesive layer for fastening to the window.

8. The antenna element according to claim 7, wherein said second antenna is configured as a cross.

9. The antenna element according to claim 7, wherein said second antenna is configured as a L.

10. The antenna element according to claim 6, wherein said second antenna is configured as a cross.

11. The antenna element according to claim 6, wherein said second antenna is configured as a L.

12. The antenna element according to claim 6, wherein said second antenna is configured as straight line.

* * * * *